US006238300B1

(12) United States Patent
Igarashi

(10) Patent No.: US 6,238,300 B1
(45) Date of Patent: May 29, 2001

(54) WOOD-TYPE GOLF CLUB HEAD FABRICATED OF METAL SHEETS

(76) Inventor: Lawrence Y. Igarashi, 30231 Tomas Rd., Rancho Santa Margarita, CA (US) 92688

( * ) Notice: Subject to any disclaimer, the term of this patent is extended or adjusted under 35 U.S.C. 154(b) by 0 days.

(21) Appl. No.: 09/156,700

(22) Filed: Sep. 18, 1998

(51) Int. Cl.[7] ..... A63B 53/04

(52) U.S. Cl. ..... 473/324; 473/345; 473/409; 473/349

(58) Field of Search ..... 473/324, 345, 473/346, 349, 350, 409

(56) References Cited

U.S. PATENT DOCUMENTS

| | | | |
|---|---|---|---|
| 4,432,549 | * | 2/1984 | Zebelean . |
| 4,438,931 | * | 3/1984 | Motomiya . |
| 4,489,945 | * | 12/1984 | Kobayashi . |
| 5,028,049 | * | 7/1991 | McKeighen . |
| 5,398,746 | | 3/1995 | Igarashi . |
| 5,405,137 | * | 4/1995 | Vincent . |
| 5,407,202 | | 4/1995 | Igarashi . |
| 5,429,357 | | 7/1995 | Kobayashi . |
| 5,465,968 | * | 11/1995 | Aizawa . |
| 5,743,813 | * | 4/1998 | Chen . |
| 5,766,094 | * | 6/1998 | Mahaffey . |

* cited by examiner

*Primary Examiner*—Sebastiano Passaniti
(74) *Attorney, Agent, or Firm*—Larry K. Roberts

(57) ABSTRACT

A wood-type golf club head is provided with a face having a double-wall construction. The use of a double-wall construction allows two different materials for the face, allowing the golf club head to be fabricated with many different weight distributions, impact sounds, different feel and different impact energy transfer characteristics. The inside face plate can be solid, or perforated with openings, provided with center ribs, or other weight distributing and strengthening features. The club head bottom, sides and the inner face can be fabricated as a unitary formed plate by a press forming process from a single sheet of a metal material. The inner face plate is bent to the desired loft, and the top plate, hosel pipe and outer plate are attached to the unitary structure by welding or other attachment techniques. Another club head has a lowered and forwardly positioned center of gravity. This is provided by a metal head section forming a hollow shell having a bottom portion, a side portion, a top portion and a face plate portion. The bottom portion, side portion and face plate portion have respective thicknesses which are relatively larger than a thickness of the top portion, thereby providing a club head in which its center of gravity is positioned relatively close to the bottom portion and toward the face plate portion. Methods for fabricating the club head using press forming processes are described.

23 Claims, 6 Drawing Sheets

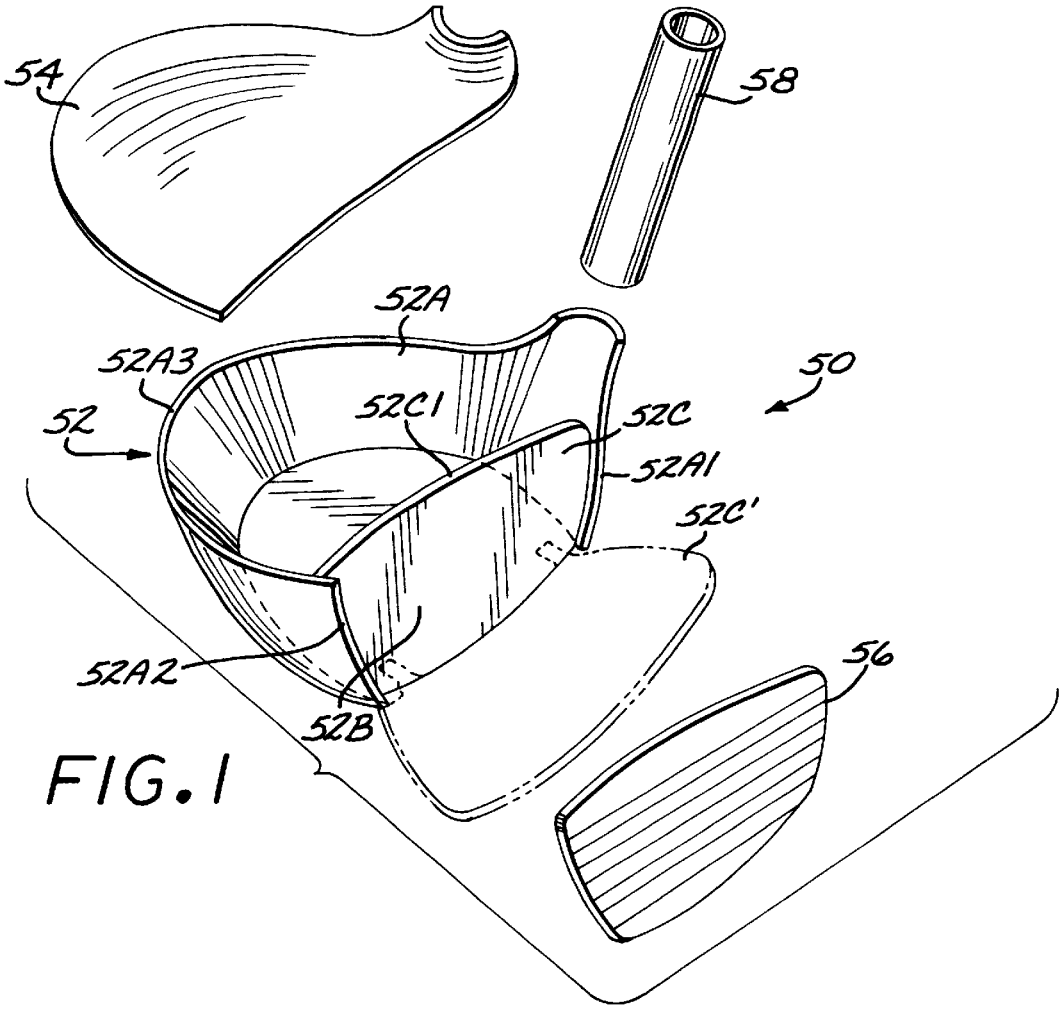
FIG. 1
FIG. 2A
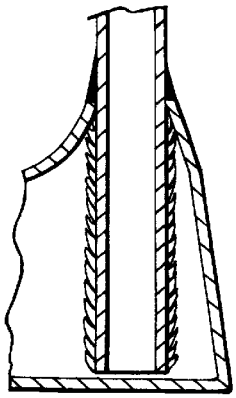
FIG. 2
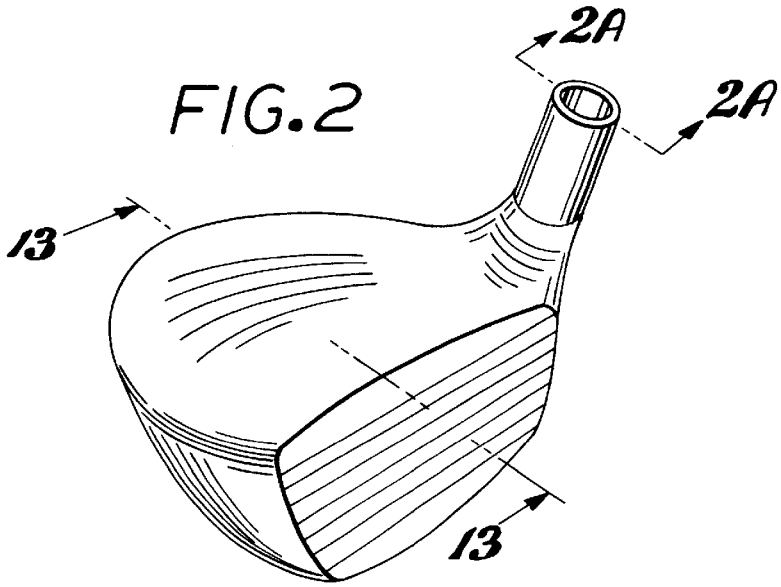

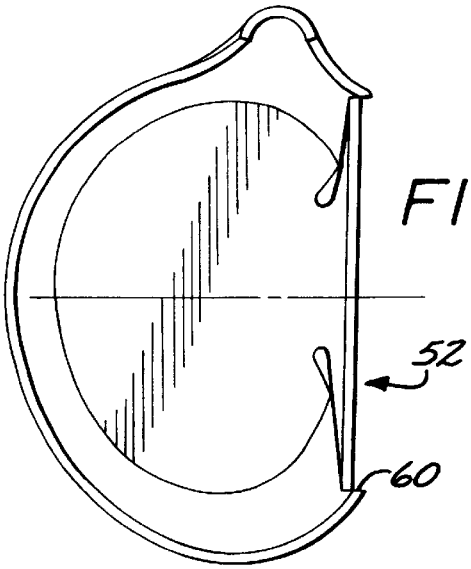
FIG. 5
FIG. 6
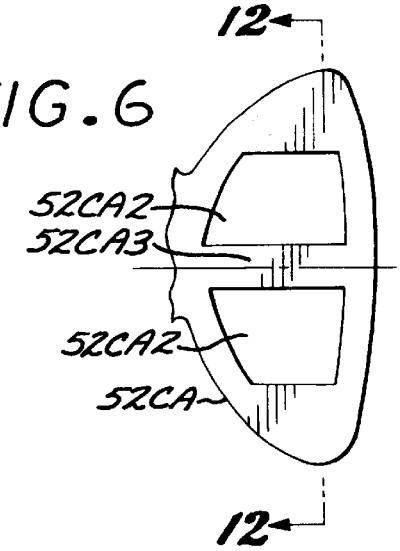
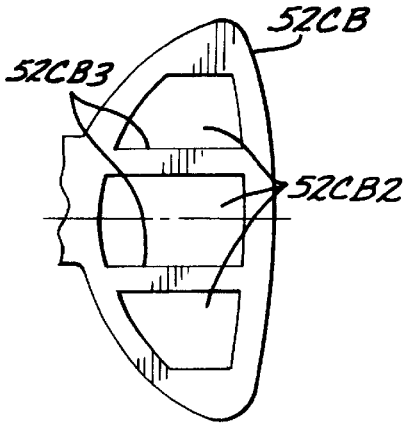
FIG. 7
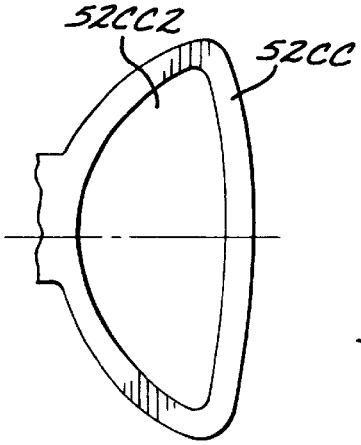
FIG. 8
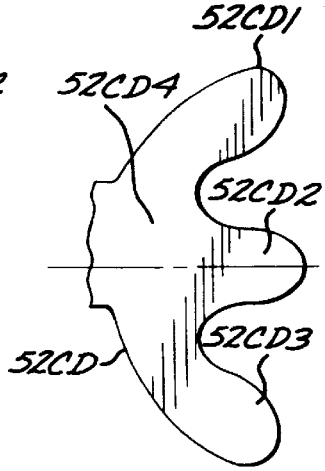
FIG. 9
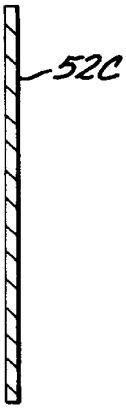
FIG. 10
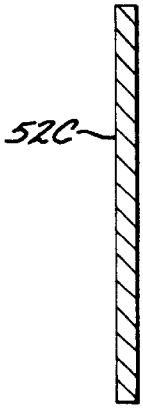
FIG. 11
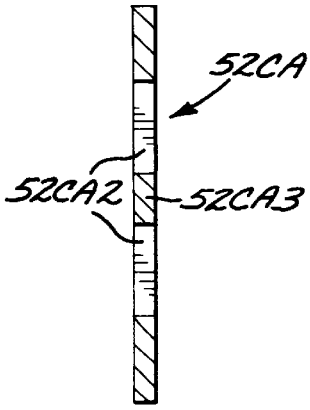
FIG. 12

WOOD-TYPE GOLF CLUB HEAD FABRICATED OF METAL SHEETS

TECHNICAL FIELD OF THE INVENTION

This invention relates to golf clubs, and more particularly to techniques for making metal wood-type club heads.

BACKGROUND OF THE INVENTION

Usually, metal wood number 1 drivers made of titanium and its alloys has thin (1 mm to 2 mm) top, bottom and side walls, and a relatively thick face (2.5 to 3.5 mm). This is due to weight limits of 170 grams to 210 grams, and strength factors to hold up against the forces of the golf ball impacting on the face. To form the top and bottom/side parts, usually the materials need to have less metal memory (softer and not to bounce back in the press forming process), and commercially pure titanium (CP grade) sheet is used, although titanium alloys such as Ti-6 Al/4 Va and beta alloy (T:-15-3-3-3) can be used with more costly processing. Fairway woods (Nos. 3, 4, 5, 6, 7, 8 and 9) have a less restrictive weight limit (200 grams to 250 grams) and thicker (2 mm to 3 mm) top and bottom/side members can be used.

SUMMARY OF THE INVENTION

In accordance with one aspect of the invention, a wood-type golf club head is provided with a face having a double-wall construction. This provides the advantages of increased face strength as well as the capability to use two different materials for the face. The use of a double-wall construction allows two different materials for the face, allowing the golf club head to be fabricated with many different weight distributions, impact sounds, different feel and different impact energy transfer characteristics. The inside face plate can be solid, or perforated with openings, provided with center ribs, or other weight distributing and strengthening features.

In accordance with another aspect of the invention, the club head bottom, sides and the inner face are all fabricated as a unitary formed plate by a press forming process from a single sheet of a metal material. The inner face plate is bent to the desired loft, and the top plate, hosel pipe and outer plate are attached to the unitary structure by welding or other attachment techniques.

A further aspect is a golf wood-type club head having a lowered and forwardly positioned center of gravity. This is provided by a metal head section forming a hollow shell having a bottom portion, a side portion, a top portion and a face plate portion. The bottom portion, side portion and face plate portion have respective thicknesses which are relatively larger than a thickness of the top portion, thereby providing a club head in which its center of gravity is positioned relatively close to the bottom portion and toward the face plate portion.

A further aspect of the invention includes methods of fabricated wood-type club heads. One method includes the steps of:

providing a sheet of a metal material;

cutting from the sheet a plate member having a peripheral configuration for forming a portion of a head shell;

press forming the plate member into a first shaped plate defining a first shell portion and a face portion; and attaching a second plate to the first shaped plate to form an assembled head shell structure.

Another method in accordance with the invention includes:

providing a sheet of a metal material, the sheet having a first thickness;

cutting from the sheet a plate member having a peripheral configuration for forming a portion of a head shell;

press forming the plate member into a shaped plate defining a bottom portion, a side portion and a face portion; and attaching a top plate to the shaped plate, the top plate having a second thickness which is substantially less than the first thickness, wherein the club head has a low center of gravity.

BRIEF DESCRIPTION OF THE DRAWING

These and other features and advantages of the present invention will become more apparent from the following detailed description of an exemplary embodiment thereof, as illustrated in the accompanying drawings, in which:

FIG. 1 is an exploded view of a metal wood golf club head embodying an aspect of the invention.

FIG. 2 is an isometric view of the golf club head of FIG. 1 in an assembled configuration.

FIG. 2A is a cross-sectional view taken along line 2A—2A of FIG. 2.

FIG. 5 is a top plan view of a shaped plate formed as shown in FIG. 4.

FIGS. 6–9 are views illustrating alternative forms of the inner face plate portion of the shaped plate of FIG. 5.

FIG. 10 is a cross-sectional view taken along line 10—10 of FIG. 3, showing a reduced thickness form of the inner face plate portion of the club head of FIG. 1.

FIG. 11 is a cross-sectional view similar to FIG. 10, but showing a thicker inner face plate portion than illustrated in FIG. 10.

FIG. 12 is a cross-sectional view taken along line 12—12 of FIG. 6.

DETAILED DESCRIPTION OF THE PREFERRED EMBODIMENT

Figure 3:
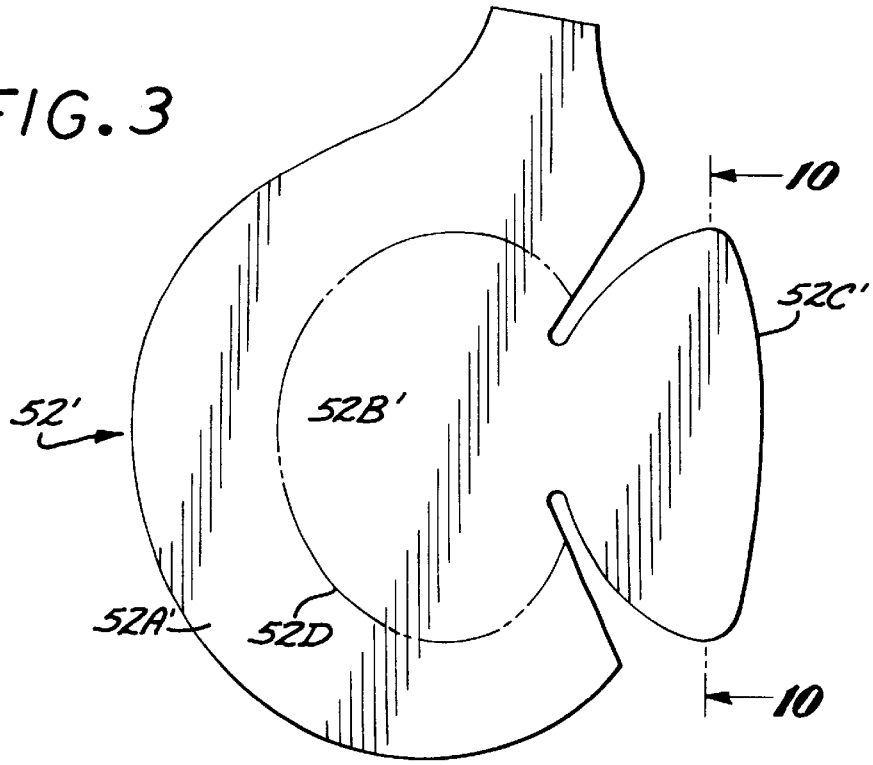
FIG. 3 is a diagrammatic plan view of a sheet which is to be shaped into the shaped plate for the side/bottom/inner face plate structure.

A metal wood-type golf club head 50 is shown in exploded form in FIG. 1. The head 50 is formed of three shaped plates, a first plate 52 which forms the bottom, sides and inner face plate portions of the head, a second top plate 54 and a third plate 56 which forms the outer face plate of the head. All of the plates are fabricated from thin sheets of metal; typically these sheets are formed by forging or casting techniques.

The first plate 52 comprises a side portion 52A, a bottom portion 52B and an inner face plate portion 52C. The bottom portion is connected to the inner face portion. The plate 52 is formed from a thin sheet of forged or cast metal, which has been cut or stamped to provide a planar plate member of the appropriate shape. This plate member is then formed into a cup-like shape by a press forming operation which forms the side and bottom portions of the club head. The inner face plate portion 52C is bent up to the desired loft. This is shown in FIG. 1, with the original position of the inner face plate portion shown in phantom as 52C', and the final position indicated in solid lines as 52C. The edges of the inner face plate portion are then welded to adjacent surfaces of the side portions 52A, leaving a space between the edges of the inner face plate portion and the outer edges 52A1 52A2 of the side portion 52A. As shown in FIG. 1, this space provides a recess, indicated generally as 60, to receive the outer face plate 56.

The head 50 includes a hosel pipe 58, which can be attached to one or more of the side portion 52A, the bottom portion 52B, and the inner plate portion 52C by welding or other conventional techniques prior to attachment by welding of the top plate 54 to the top edge 52A3 of the side portion 52. The attachment of the hosel pipe 58 is illustrated in FIG. 2A. The top plate 54 can also be welded for increased strength at the top edge 52C1 of the inner face portion 52C.

The outer face plate 56 is positioned in the recess formed in front of the inner face portion 52C, and can be welded to the edges 52A1, 52A2 of the side portion 52A, to the top and bottom of the inner face portion 52C, to the top plate 54, or only to some of these surfaces, depending on the particular design requirements.

In accordance with an aspect of the invention which results in lower fabrication costs, the plate 52 is formed of a material which is readily formable by a press forming operation. Such press forming operations are well known in the metal processing arts, and are used to form metal pans, for example. An exemplary material suitable for the purpose of the plate 52 is commercial pure (CP) Titanium. Other materials useful for the plate 52 include Titanium alloys, steel and aluminum. The plate 52 can be formed to have a thickness in the range of 1 mm to 3 mm.

The top plate 54 can be formed of CP Titanium. Other more costly materials such as Ti:6-4, Beta (Ti-15-3-3-3-3) can alternatively be employed.

The outer face plate 56 is fabricated of a high strength material capable of withstanding the ball impact forces. Exemplary materials suitable for the purpose include Titanium alloys such as Ti-6/4, beta Ti-15-3-3-3-3, and Zirconium-Titanium alloys. These materials can be welded to the CP titanium material of the plate 52. Other attachment techniques can alternatively be employed, including use of adhesives or fastener elements such as screws.

The selection of materials for the three plates will take into account the particular attachment technique; if the plates are welded, then materials which are weldable together will be employed.

The hosel pipe 58 can be formed of any material, having sufficient strength to hold the golf club shaft. Suitable materials include CP Titanium, Ti:-6/4, or other alloys of Titanium.

In one embodiment, the plate 52 has a uniform thickness in the range of 1 mm to 3 mm. The inner face plate portion 52C can remain the same thickness as the bottom and side plate portions, or can be milled down to 0.5 mm to 1.5 mm. An exemplary thickness of the outer face plate 56 is 1.5 mm to 3.5 mm. There can be many different thickness combinations of the inside face plate portion 52C and outer face plate 56.

Figure 13:
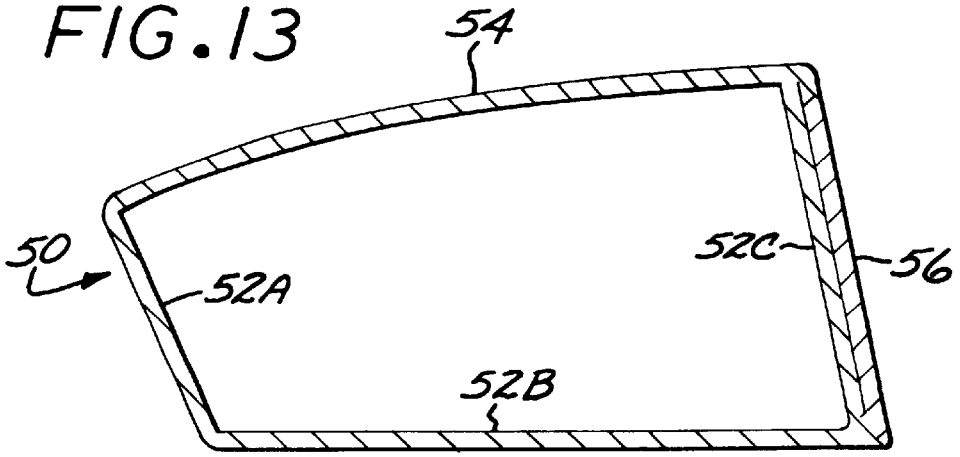
FIG. 13 is a cross-sectional view taken along line 13—13 of FIG. 2.
Figure 14:
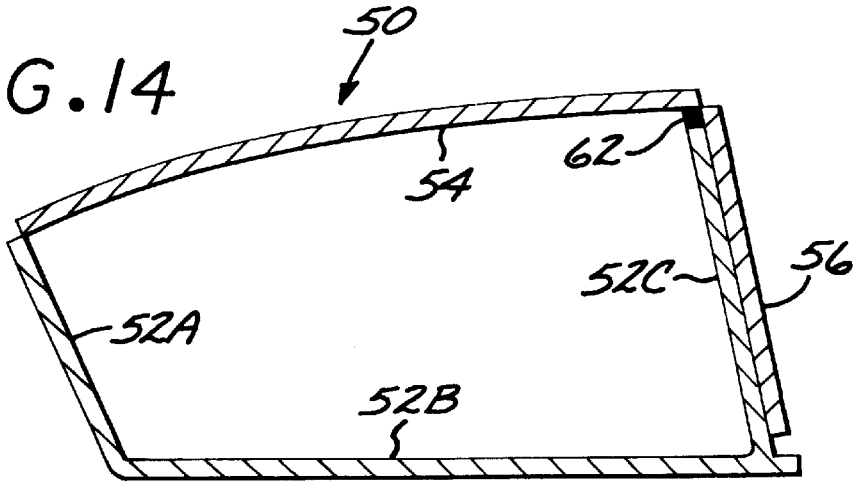
FIGS. 14 and 15 are similar to FIG. 13, but showing the club head in different stages of welding of the plates.
Figure 15:
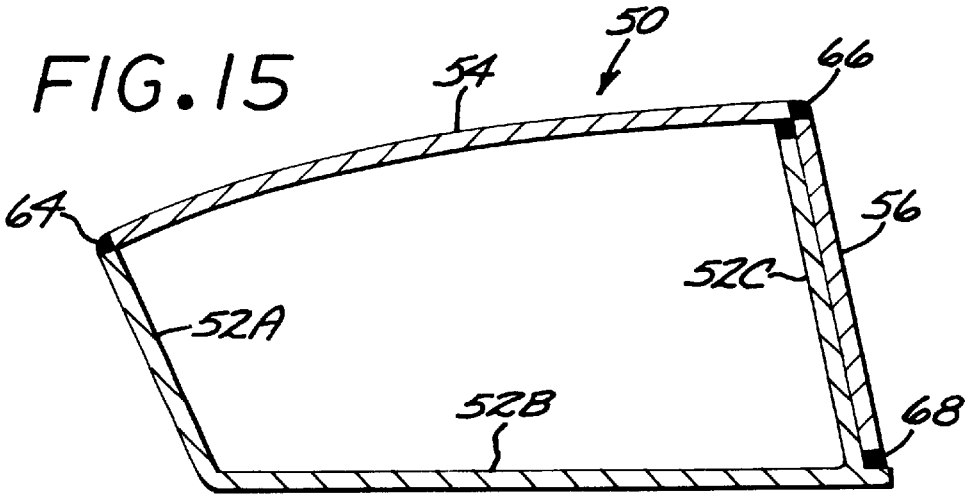

FIG. 2 is an isometric view of the club head 50 in a fully assembled configuration, wherein the exposed welds have been ground down to provide a finished club head. The head is now ready for attachment of the shaft in the hosel pipe in the conventional manner. FIG. 13 is a cross-sectional view of the club head of FIG. 2, illustrating the outer face plate 56 after attachment to the shell structure formed by the two shaped plates 52 and 54. FIG. 14 is a cross-sectional view similar to FIG. 13, taken prior to completion of the welds connecting the top plate 54 and the plate 52. One exemplary weld bead 62 along adjoining edges of the top plate 54 and the inner face plate portion 52C is illustrated. FIG. 15 shows the same view but taken after the welding has been completed with weld bead 64 connecting the top edge of the side plate portion 52A to the top plate 54, and beads 66 and 68 connecting the outer face plate to the top plate 56 and the bottom plate portion 52B, respectively.

FIG. 3 is a diagrammatic plan view of a plate 52' which is to be shaped into the shaped plate 52. Plate 52' is shown in FIG. 3 in a form after being stamped or cut from a sheet of metal. This figure is not to scale, and the dotted line 52D is illustrative of the location of the bottom/side wall edge to be formed by the press forming operation. The side wall portion is indicated as 52A', and the bottom portion is indicated as 52B'. The exact shape of the plate 52' for a particular club head design will be dependent on the type of wood head and its size, and FIG. 3 is only intended to illustrate a generalized shape and outline.

Figure 4:
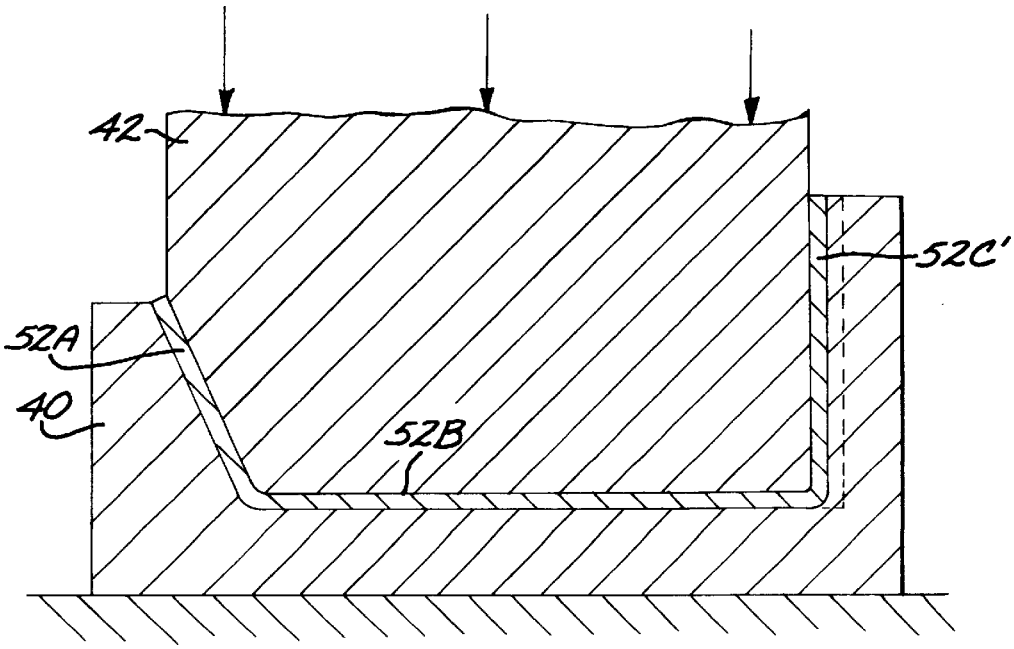
FIG. 4 is a diagrammatic view taken in cross-section through a set of press forming die, generally illustrating a press forming process for forming the shaped plates.

FIG. 4 is a diagrammatic view taken in cross-section through a set of press forming die 40, 42, generally illustrating a press forming process for forming the shaped plate 52. The plate 52' is placed over the cavity defined by the lower die 40, and the upper die 42 is forced downwardly to press the plate 52' to conform to the shape defined by the die 40, 42. In this exemplary representation, the inner face plate portion 52C' is bent upwardly to a roughly 90 degree angle with respect to the bottom plate portion 52B', and can subsequently be positioned to the desired loft angle, e.g. in a jig or manually. The part after removal from the forming die is shown in the top view of FIG. 5. Press forming as a metal working technique is well known in the metal forming arts. A similar press forming technique is employed to shape the top plate 54.

The inner face plate portion 52C can take many different forms. It can be a solid, essentially planar form as shown in FIG. 1. Alternatively, the plate portion 52C can have a full periphery, behind the outer plate 56, but with one or more opening 52C formed therein. FIG. 6 and the corresponding cross-sectional view of FIG. 12 show a first alternative embodiment of the inner plate portion 52CA, wherein two openings 52CA2 are separated by a rib portion 52CA3. FIG. 7 shows a second alternative form of the inner plate portion 52CB, with three openings 52CB2 formed therein, separated by ribs 52CB3. FIG. 8 shows a third alternative embodiment of the inner face plate 52CC, having a single large opening 52CC2 formed therein. FIG. 9 shows a fourth alternative embodiment of the inner face plate 52CD wherein a plurality of finger portions 52CD1–3 are formed by the plate portion, joined only at the connection portion 52CD4. The particular form of the inner face plate portion 52C will depend on the particular club head design, to achieve weight distribution and strengthening characteristics for the particular club head.

As noted above, the thickness of the inner face plate portion 52C can be selected as well to provide particular weight distribution and reinforcing characteristics. The inner portion 52C can have a thickness thinner than the thickness of the side and bottom portions 52A, 52B, or can be the same thickness. FIG. 10 illustrates a thinner thickness of the inner face plate portion 52C, achieved by milling or other conventional techniques. FIG. 11 shows the inner plate portion 52C at the same thickness as the side and bottom portions 52A, 52B.

Figure 16:
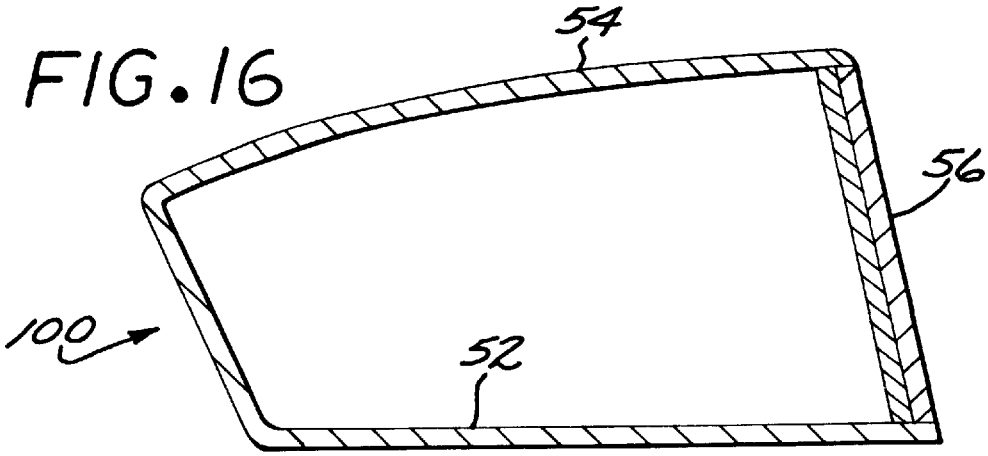
FIG. 16 is a cross-sectional view representing an alternate embodiment of a wood club head embodying the invention.

While the embodiments of FIGS. 1–15 have employed inner face plate portions which are attached to another portion of the club shell, a separate inner plate and a separate outer can be employed, to produce a double walled face plate. This embodiment is shown in FIG. 16, wherein a club head 100 includes a separate inner face plate 102, a separate outer face plate 104, with bottom, side and top portions 106A–C, respectively. The plates 102 and 104 are attached by welding or other attachment techniques to the structure comprising portions 106A–C. The plates 102 and 104 can be the same material, or preferably different metal materials.

Figure 17:
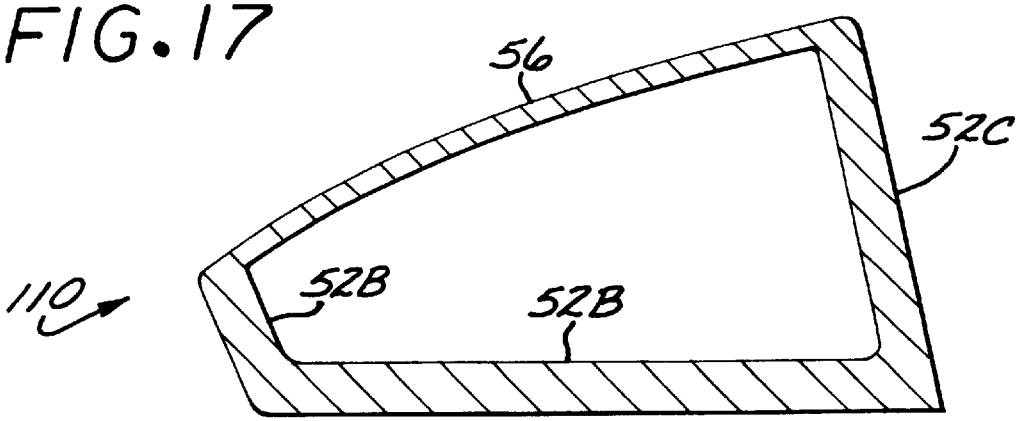
FIG. 17 is a cross-sectional view representing a fairway wood having a lowered and forwardly positioned center of gravity in accordance with an aspect of the invention.
Figure 18:
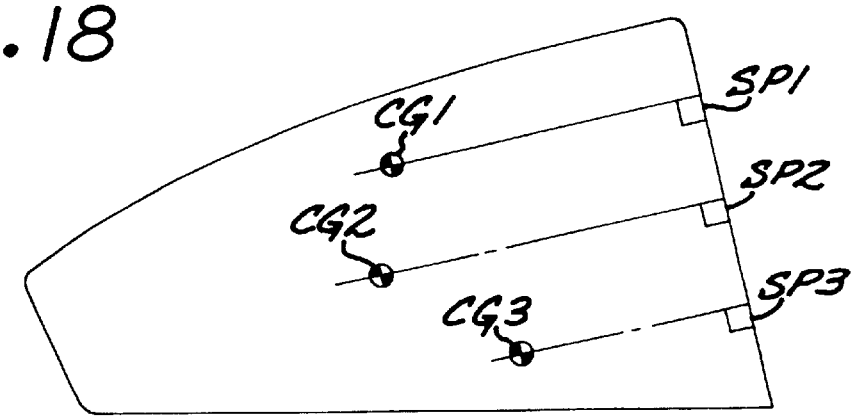
FIG. 18 is a diagrammatic view illustrating the lowering of the sweet spot using weight distribution for the fairway wood of FIG. 17.

The foregoing embodiments of the invention are applicable to all wood-type golf clubs, and are particularly useful for drivers. Fairway woods, e.g. woods # 2, 3, 4, 5, 6, 7, 8 and 9, can also be fabricated in accordance with the invention. The fairway woods can be somewhat heavier than the driver clubs. To further simplify the construction of the fairway wood, the outer face plate can be dispensed with, so that the shaped plate 52 forms the ball striking face. This is shown in FIG. 17 as fairway wood 110, wherein the side portion, bottom portion and face plate portions 52A, 52B and 52C are all formed from a single sheet of relatively thick metal, again in the thickness range of 3 mm to about 4.5 mm, and the top plate 56 is formed of a thinner sheet, on the order of 1 mm to 2 mm. In this particular embodiment, a thicker sheet is used for the plate 52, on the order of 3 mm to 4.5 mm, of the same metal materials as described above for the embodiments of FIGS. 1–15. The top plate 56 is formed of a thinner sheet of the metal, on the order of 1 mm to 2 mm. Using a thinner sheet for the top plate 54 than is used for the plate 52 results in lowering the center of gravity, and lowering the position of the sweet spot on the face plate. The heavier weighting is positioned toward the face, or more forwardly toward the face, than is the case for the top plate of the same thickness/density, as illustrated in the diagrammatic depiction of FIG. 18. The sweet spot is the perpendicular projection of the center of gravity onto the face plate. Three exemplary centers of gravity and corresponding sweet spots are illustrated in FIG. 18, showing how the sweet spot can be lowered by lowering and moving forward the center of gravity. CG1 is relatively high, and disposed toward the rear of the club head, resulting in a high sweet spot SP1. CG2 is more centrally located, resulting in a central sweet spot SP2. CG3 is lowered and moved forwardly toward the face plate, resulting in a lowered sweet spot SP3. CG3 can be achieved using the arrangement of FIG. 16.

Figure 19:
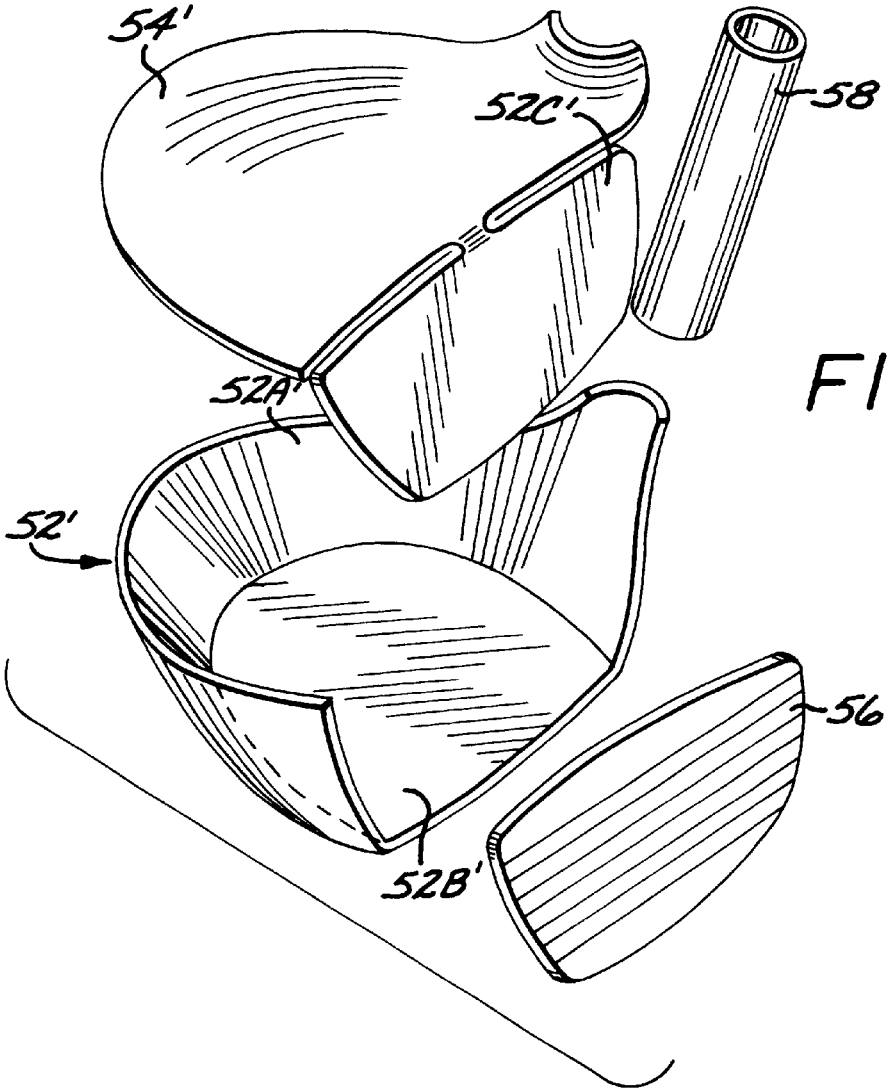
FIG. 19 is an isometric view of an alternate embodiment of a wood-type club head, wherein the inner face plate is connected to the top plate sheet.

While the face plate portion 52C has been shown as connected to the bottom plate portion 52B, it can alternatively be formed as a connected part of the top plate 56. This alternate embodiment is illustrated in FIG. 19 as club head 50', wherein the top plate 56' includes a top plate portion 56A and a face plate portion 56B. The top plate 56' is formed of a sheet of material, which is then press formed into the shaped part illustrated in FIG. 20; the plate portion is bent down to achieve the desired loft for attachment to the side/bottom shaped plate. The bottom and side plate portions 52B' and 52C' are formed as portions of a single shaped plate, in the same manner as described with respect to the embodiments of FIGS. 1–15, except that a face plate portion is omitted.

It is understood that the above-described embodiments are merely illustrative of the possible specific embodiments which may represent principles of the present invention. Other arrangements may readily be devised in accordance with these principles by those skilled in the art without departing from the scope and spirit of the invention.

What is claimed is:

1. A golf wood-type club head, comprising:

an outer face plate;

a metal head section forming a hollow shell having a bottom portion, a side portion, a top plate and an inner face plate portion, said outer face plate attached to said hollow shell to overlay said inner face plate portion, wherein said bottom portion, said side portion and said inner face plate portion define a unitary formed cup structure fabricated from a single sheet of a metal material, and said top plate is a separate structural member from said cup structure, said top plate and said cup structure joined together along seams to define said hollow shell.

2. The golf club head of claim 1 wherein said outer face plate is fabricated of an outer face metal material, and said metal material of said single sheet is a different metal material from the outer face plate metal material.

3. The golf club head of claim 1 wherein said outer face plate is fabricated of said metal material from which said cup structure is fabricated.

4. The golf club head of claim 1 wherein said inner face plate portion comprises a solid planar portion extending across and behind the outer face plate.

5. The golf club head of claim 1 wherein said inner face plate portion comprises a planar portion having at least one opening formed therein and extending across and behind the outer face plate.

6. The golf club head of claim 1 wherein said metal material of said single sheet is commercial pure titanium, or a titanium alloy, or a stainless steel, or aluminum or an aluminum alloy.

7. The golf club head of claim 6 wherein said metal material is commercial pure titanium, and said outer face plate is fabricated of a titanium alloy.

8. The golf club of claim 6 wherein said top plate is attached to said cup structure.

9. The golf club head of claim 1 further comprising a hosel pipe having a pipe portion disposed within the hollow shell and connected to said metal head section.

10. The golf club head of claim 1 wherein said metal material of said single sheet is a material which is readily formable by a press forming process.

11. The golf club head of claim 10, wherein said outer face plate is fabricated of a high strength metal capable of withstanding golf ball impact forces.

12. The golf club head of claim 1 wherein said single sheet has a uniform thickness.

13. The golf club head of claim 1 wherein said inner face plate portion comprises a rib portion separated by respective openings from said side portions.

14. The golf club head of claim 1 wherein said single sheet has a uniform thickness, and said outer face plate is fabricated of a high strength metal capable of withstanding golf ball impact forces.

15. The golf club head of claim 14 wherein said single sheet is fabricated of commercial pure titanium, and the outer face plate is fabricated of a titanium alloy.

16. The golf club head of claim 14 wherein the top plate is fabricated of commercial pure titanium.

17. A golf wood-type club head having a lowered and forwardly positioned center of gravity, comprising:

a metal head section forming a hollow shell having a bottom portion, a side portion, a top plate and a face plate portion;

said top plate fabricated from a sheet of a metal material and having a uniform top plate thickness;

said bottom portion, said side portion and said face plate portion define a unitary formed cup structure fabricated from a single sheet of said metal material, said bottom portion, said side portion and said face plate portion having a uniform thickness relatively larger than said thickness of said top plate, thereby providing a club head in which its center of gravity is positioned relatively close to the bottom portion and toward the face plate portion.

18. The club head of claim 17 wherein said respective thickness of said bottom portion, said side portion and said face plate portion are in the range of 3 mm to 4.5 mm, and said thickness of said top plate is in the range of 1 mm to 2 mm.

19. The club head of claim 18 wherein said metal head section is fabricated of commercial pure titanium, or a stainless steel, or aluminum or an aluminum alloy.

20. A golf wood-type club head, comprising:

an outer face plate;

a metal head section forming a hollow shell having a bottom portion, a side portion, a top portion plate and an inner face plate portion, said outer face plate attached to said metal head section to overlay said inner face plate portion, wherein said top portion and said inner face plate portion are fabricated as a first unitary member fabricated from metal sheet material, said side portion and said bottom portion are fabricated as a second unitary member fabricated from said metal sheet material, and said first unitary member and said second unitary member are joined together along adjoining seams.

21. The golf club head of claim 20 wherein said metal sheet material is a material which is readily formable by a press forming process.

22. The golf club head of claim 21 wherein said outer face plate is fabricated of a high strength material capable of withstanding golf ball impact forces.

23. The golf club head of claim 20 further comprising a hosel pipe having a pipe portion disposed within the hollow shell and connected to said metal head section.

* * * * *